US011090924B2

(12) United States Patent
Anderson et al.

(10) Patent No.: US 11,090,924 B2
(45) Date of Patent: Aug. 17, 2021

(54) FLUIDIC DIE WITH NOZZLE DISPLACEMENT MASK REGISTER

(71) Applicant: HEWLETT-PACKARD DEVELOPMENT COMPANY, L.P., Spring, TX (US)

(72) Inventors: Daryl E Anderson, Corvallis, OR (US); Eric Martin, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/492,276

(22) PCT Filed: Apr. 14, 2017

(86) PCT No.: PCT/US2017/027594
§ 371 (c)(1),
(2) Date: Sep. 9, 2019

(87) PCT Pub. No.: WO2018/190861
PCT Pub. Date: Oct. 18, 2018

(65) Prior Publication Data

US 2020/0406608 A1 Dec. 31, 2020

(51) Int. Cl.
*B41J 2/045* (2006.01)
*B41J 2/21* (2006.01)

(52) U.S. Cl.
CPC ..... *B41J 2/0451* (2013.01); *B41J 2/04541* (2013.01); *B41J 2/04558* (2013.01); *B41J 2/2139* (2013.01)

(58) Field of Classification Search
CPC .. B41J 2/04543; B41J 2/04545; B41J 2/0451; B41J 2/2139; B41J 2/04541
See application file for complete search history.

(56) References Cited

U.S. PATENT DOCUMENTS 6,520,611 B2 * 2/2003 Ishinaga ..... B41J 2/04518 347/19
6,979,068 B2 12/2005 Kanematsu
(Continued)

FOREIGN PATENT DOCUMENTS

WO WO-9908875 A1 * 2/1999 ..... B41J 29/393

OTHER PUBLICATIONS

Luis, V.J., et al., HP Inkjet Large Format Page Wide Array: Solution for Drop Detection and Nozzle Replacement Jan. 2015. < http://www.ingentaconnect.com/contentone/ist/nipdf/>.

*Primary Examiner* — Julian D Huffman
(74) *Attorney, Agent, or Firm* — Dicke Billig & Czaja PLLC

(57) ABSTRACT

A fluidic die includes an array of nozzles, each nozzle to eject a fluid drop in response to a corresponding actuation signal having an actuation value. The fluidic dies includes nozzle select logic to provide, for each nozzle, a nozzle select signal having a select value or a non-select value, with a select value indicating the nozzle is select to eject a fluid drop, a nozzle displacement register to receive displacement bits, each displacement bit corresponding to a different one of the nozzles and having an enable value or a disable value, a disable value indicating a defective nozzle, and actuation logic, for each nozzle having a corresponding nozzle select signal having a select value, the actuation logic to provide an actuation signal having an actuation value to an operational neighboring nozzle instead of to the selected nozzle when the corresponding displacement bit has a disable value.

15 Claims, 7 Drawing Sheets

(56) References Cited

U.S. PATENT DOCUMENTS

| | | | |
|---|---|---|---|
| 7,585,038 | B2 | 9/2009 | Shibata et al. |
| 7,866,779 | B2 | 1/2011 | Martinez et al. |
| 2002/0008723 | A1 | 1/2002 | Wen et al. |
| 2004/0223014 | A1 | 11/2004 | Barr |
| 2005/0225585 | A1 | 10/2005 | Takizawa et al. |
| 2006/0268056 | A1 | 11/2006 | Molinet et al. |
| 2016/0288491 | A1 | 10/2016 | Hoshii |

* cited by examiner

FLUIDIC DIE WITH NOZZLE DISPLACEMENT MASK REGISTER

BACKGROUND

Fluidic dies may include an array of nozzles, where each nozzle includes a fluid chamber, a nozzle orifice, and a fluid actuator, where the fluid actuator may be actuated to cause displacement of fluid and cause ejection of a fluid drop from the nozzle orifice. Some example fluidic dies may be printheads, where the fluid may correspond to ink.

Figure 1:
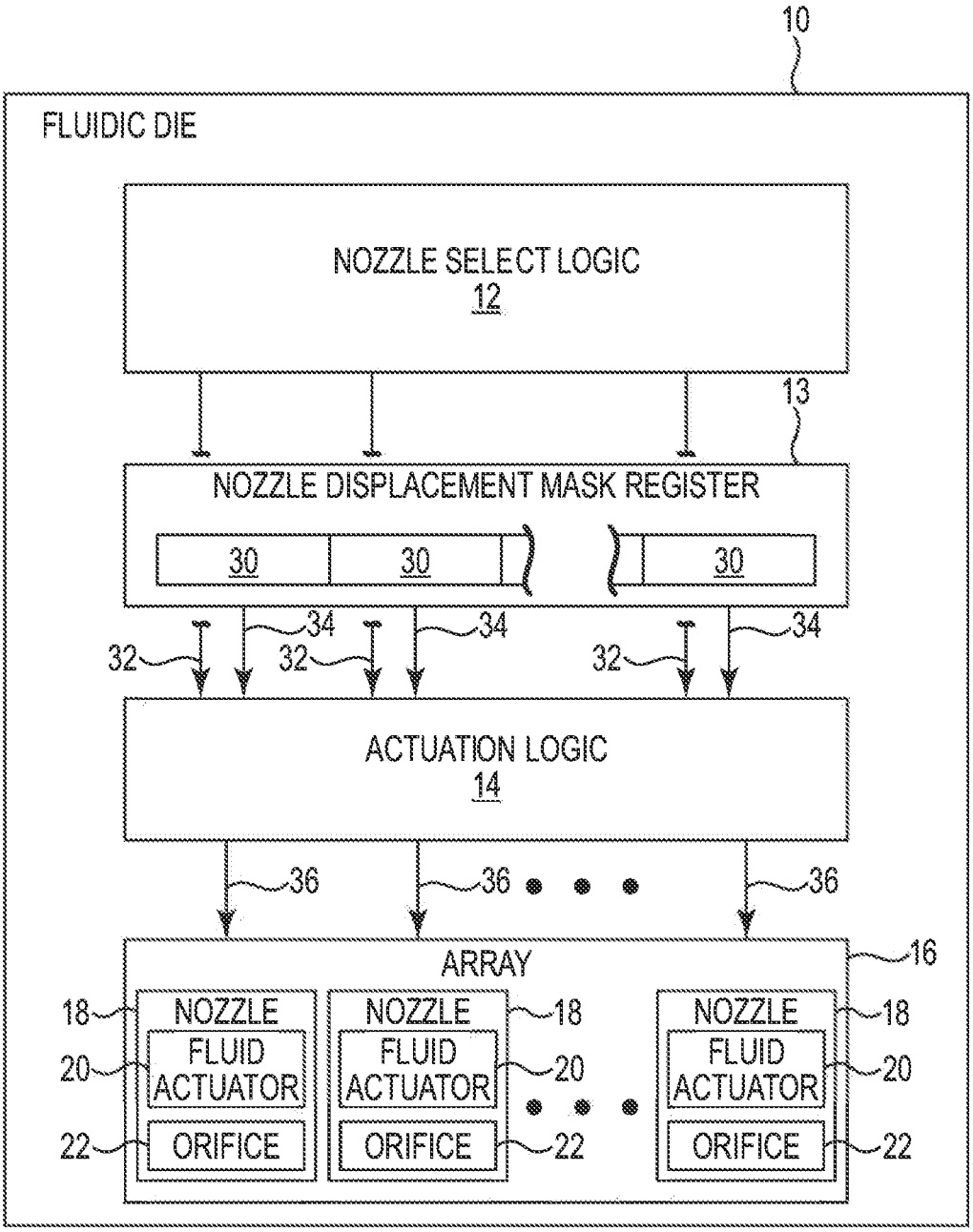
FIG. 1 is a block and schematic diagram illustrating a fluidic die according to one example.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Examples of fluidic dies may comprise fluid actuators. The fluid actuators may include a piezoelectric membrane based actuator, a thermal resistor based actuator, an electrostatic membrane actuator, a mechanical/impact driven membrane actuator, a magneto-strictive drive actuator, or other such elements that may cause displacement of fluid responsive to electrical actuation. Fluidic dies described herein may comprise a plurality of fluid actuators, which may be referred to as an array of fluid actuators. Moreover, an actuation event, as used herein, may refer to concurrent actuation of fluid actuators of the fluidic die to thereby cause fluid displacement.

In example fluidic dies, the array of fluid actuators may be arranged in respective sets of fluid actuators, where each such set of fluid actuators may be referred to as a "primitive" or a "firing primitive." A primitive generally comprises a group of fluid actuators that each have a unique actuation address. In some examples, electrical and fluidic constraints of a fluidic die may limit which fluid actuators of each primitive may be actuated concurrently for a given actuation event. Therefore, primitives facilitate addressing and subsequent actuation of fluid ejector subsets that may be concurrently actuated for a given actuation event. A number of fluid ejectors corresponding to a respective primitive may be referred to as a size of the primitive.

To illustrate by way of example, if a fluidic die comprises four primitives, where each respective primitive comprises eight respective fluid actuators (each eight fluid actuator group having an address 0 to 7), and electrical and fluidic constraints limit actuation to one fluid actuator per primitive, a total of four fluid actuators (one from each primitive) may be concurrently actuated for a given actuation event. For example, for a first actuation event, the respective fluid actuator of each primitive having an address of 0 may be actuated. For a second actuation event, the respective fluid actuator of each primitive having an address of 1 may be actuated. As will be appreciated, the example is provided merely for illustration purposes. Fluidic dies contemplated herein may comprise more or less fluid actuators per primitive and more or less primitives per die.

Some example fluidic dies comprise microfluidic channels. Microfluidic channels may be formed by performing etching, microfabrication (e.g., photolithography), micromachining processes, or any combination thereof in a substrate of the fluidic die. Some example substrates may include silicon based substrates, glass based substrates, gallium arsenide based substrates, and/or other such suitable types of substrates for microfabricated devices and structures. Accordingly, microfluidic channels, chambers, orifices, and/or other such features may be defined by surfaces fabricated in the substrate of a fluidic die. Furthermore, as used herein a microfluidic channel may correspond to a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.). Example fluidic dies described herein may comprise microfluidic channels in which fluidic actuators may be disposed. In such implementations, actuation of a fluid actuator disposed in a microfluidic channel may generate fluid displacement in the microfluidic channel. Accordingly, a fluid actuator disposed in a microfluidic channel may be referred to as a fluid pump.

In some examples, a fluid actuator may be disposed in a nozzle, where the nozzle may comprise a fluid chamber and a nozzle orifice in addition to the fluid actuator. The fluid actuator may be actuated such that displacement of fluid in the fluid chamber may cause ejection of a fluid drop via the nozzle orifice. Accordingly, a fluid actuator disposed in a nozzle may be referred to as a fluid ejector.

Fluidic dies may include an array of nozzles (such as columns of nozzles, for example), where fluid drops (such as ink drops, for example) are selectively ejected from nozzles by selective operation of their respective fluid actuators. During operation, conditions may arise that adversely affect the ability of nozzles to properly eject fluid drops. For example, a blockage may occur in the nozzle orifice or fluid chamber, or fluid may become solidified on the fluid actuator.

Techniques, such as optical drop detect and drive bubble detect (DBD), for example, have been developed to detect such conditions and thereby determine whether a nozzle is defective. Typically, an off-die controller tracks which nozzles have been determined to be defective and compensates for the loss of defective nozzles by adjusting actuation data to avoid using defective nozzles. However, such compensation techniques increase the amount of data required to be transferred between the off-die controller and the fluidic die.

FIG. 1 is a block and schematic diagram generally illustrating a fluidic die 10, in accordance with one example of the present disclosure, having a nozzle displacement register including a displacement bit for each nozzle of an array of nozzles, the displacement bit indicative of whether the nozzle is operational or defective. According to one example, when a nozzle is selected for ejection of a fluid drop, if the corresponding displacement bit is set, a neighboring nozzle is directed to eject a fluid drop instead of the selected nozzle. By directing or displacing an actuation operation away from a defective nozzle to a neighboring nozzle based on the value of the corresponding displacement bit in the nozzle displacement register, the process of displacing actuation operations away from defective nozzles is performed by fluidic die 10 rather than an off-die controller, thereby offloading data associated with such operations from the data "pipeline" between the off-die controller and the fluidic die.

In the illustrative example of FIG. 1, fluidic die 10 includes nozzle select logic 12, a nozzle displacement mask register 13, actuation logic 14, and an array 16 of nozzles 18, with each nozzle 18 including a fluid actuator 20 and a nozzle orifice 22, and each nozzle configured to selectively eject fluid drops through nozzle orifice 22 via actuation of fluid actuator 20. In one example, nozzles 18 of array 16 may be arranged so to form one or more columns of nozzles 18.

According to one example, nozzle select logic 12 provides nozzle select signals 32 for selecting which nozzles 18 of array 16 are to eject fluid drops during an actuation event. In one instance, nozzle select logic 12 provides a nozzle select signal 32 for each nozzle 18, each nozzle select signal 32 having either a select value (e.g., a "1") when a nozzle is selected for actuation, or a non-select value (e.g., a "0") when a nozzle is to be inactive during an actuation event.

Nozzle displacement mask register 13, according to one example, includes a plurality of displacement bits 30, each displacement bit 30 corresponding to a different one of the nozzles 18 of array 16, and each displacement bit 30 indicative of an operational status of the corresponding nozzle 18. In one example, a displacement bit 30 having an "enable value" (e.g., a value of "0"), indicates that the corresponding nozzle is operational, while a "disable value" (e.g., a value of "1") indicates that the corresponding nozzle is defective (i.e., non-operational). In one example, the state of each displacement bit 30 is communicated to actuation logic 14 via a corresponding path 34.

Actuation logic receives nozzle select signals 32 from nozzle select logic 12 and displacement bits 30 via paths 34. Actuation logic 14 provides actuation signals 36 to control the actuation of fluid actuators 20 of nozzles 18 to eject fluid drops. In one example, actuation logic 14 provides an actuation signal 36 for each nozzle 18 to control actuation of the corresponding fluid actuator. In one example, each actuation signal has an actuation value (e.g. a "1") or a non-actuation value (e.g. a "0"), with an actuation values causing the fluid actuator 20 of the corresponding nozzle 18 to eject a fluid drop.

In one example, for each nozzle select signal 34 having a select value, actuation logic 14 provides an actuation signal 36 having an actuation value to the corresponding nozzle 18 (the so-called "selected" or "target" nozzle) when the corresponding displacement bit has an enable state. However, if the displacement bit has the disable state, actuation logic 14 provides an actuation signal 36 having an actuation value to a neighboring nozzle 18 instead of to the selected nozzle 18. In other words, for a select signal 34 having the select value for a selected nozzle 18 that has been determined to be defective (i.e., with a corresponding displacement bit having a disable state), actuation logic 14 redirects or displaces the ejection of a fluid drop from the selected or target nozzle to a neighboring nozzle.

Figure 2:
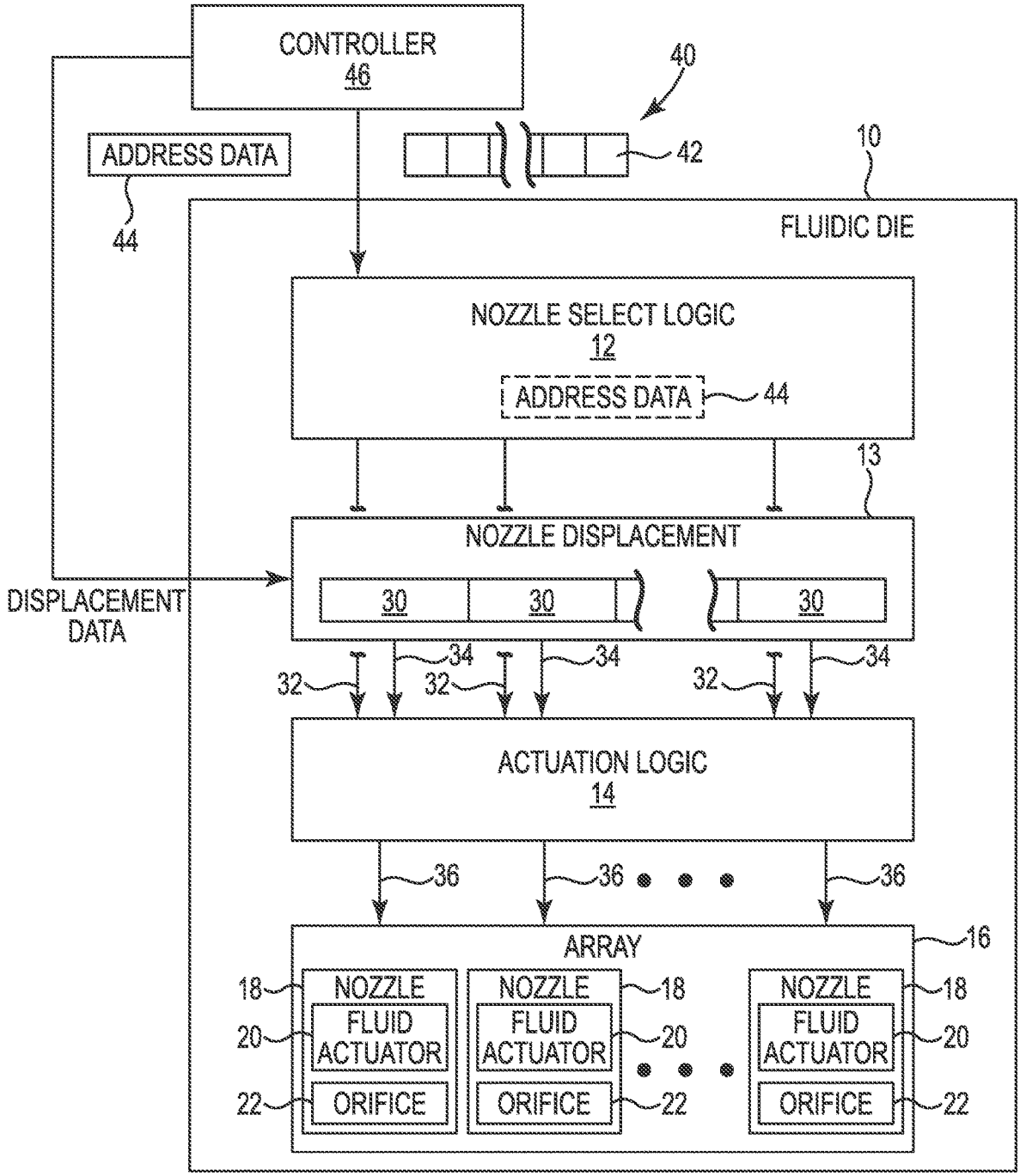
FIG. 2 is a block and schematic diagram illustrating a fluidic die according to one example.

With reference to FIG. 2, according to one example, nozzle select logic 12 receives actuation data 40, such as from a controller 46, where actuation data 40 includes a plurality of actuation data bits 42, each actuation data bit 42 corresponding to a different one of the nozzles 18, and each actuation data bit 42 having an actuation value (e.g., a value of "1") or a non-actuation value (e.g., a value of "0"). In one example, nozzle select logic 12 further receives address data 44 corresponding to each nozzle 18, the address data for each nozzle 18 having an enable value or a non-enable value indicative of whether the nozzle 18 is enabled for ejection of fluid drops during a given actuation event. In other examples, address data 44 may be internally generated by fluidic die 10, such as by nozzle select logic 12 (as indicated by the dashed lines in FIG. 2).

In one example, nozzle select logic 12 provides for each nozzle 18 a nozzle select signal 32 having the select value (e.g., a value of "1") when the corresponding address data 30 has the enable value and the corresponding actuation data bit 42 has the actuation value, and a nozzle select signal 32 having the non-select value (e.g., a value of "0") when the corresponding address data 30 has the non-enable value or the corresponding actuation data bit 44 has the non-actuation value.

Figure 3:
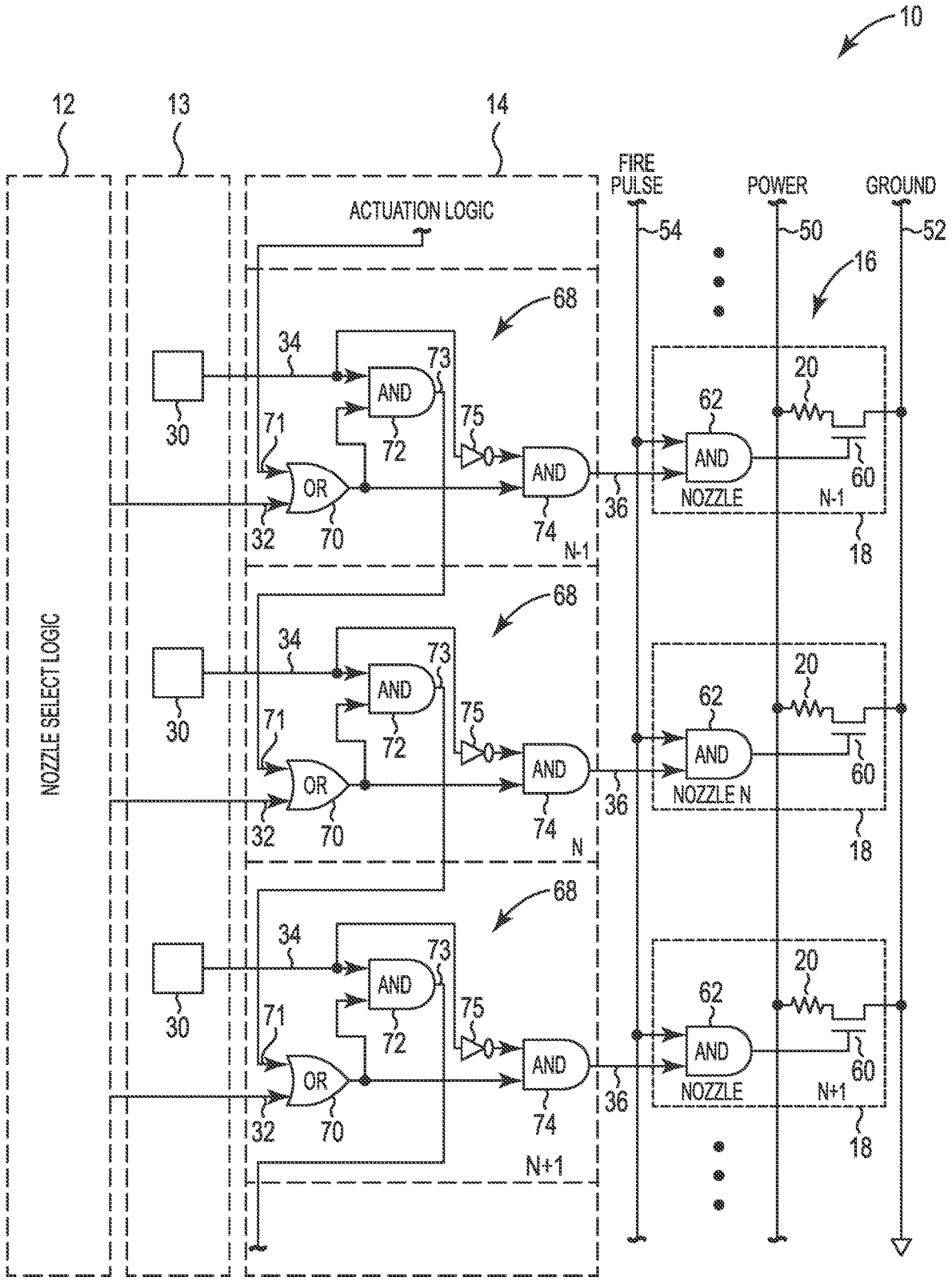
FIG. 3 is a block and schematic diagram illustrating a fluidic die according to one example.

FIG. 3 is a block and schematic diagram illustrating portions of a fluidic die 10, including an example of actuation logic 14, in accordance with one instance of the present disclosure. In the example of FIG. 3, nozzles 18 of array 16 are arranged to form a column, with a portion of such column being illustrated by nozzles N, N−1, and N+1, with nozzles N−1 and N+1 representing immediately adjacent "neighbors" of nozzle N (i.e., the nozzles immediately on each side of nozzle N). While only three nozzles 18 are illustrated (N−1, N, N+1), in other instances, a column may include more than three nozzles, and array 16 may include than one column of nozzles.

In one example, each nozzle 18 includes a fluid actuator 20 (e.g., a thermal resistor, sometimes referred to as a firing resistor) coupled between a power line 50 and a ground line 52 via an activation device, such as a controllable switch 60 (e.g., a field effect transistor (FET)), which is controlled via an output of a corresponding AND-gate 62.

According to one example, for each nozzle 18, actuation logic 14 includes a corresponding logic instance 68 including an OR-gate 70, a first AND-gate 72, a second AND-gate 74, and an inverter 75. In the illustrated example, for each logic instance 68, OR-gate 70 has a first input coupled to the corresponding nozzle select signal 32 from nozzle select logic 12, and a second input receiving the output of AND-gate 72 of the logic instance 68 corresponding to a first neighboring nozzle 18 (e.g., the "upstream" nozzle, N−1, of the column of nozzles 18 in the illustrative example of FIG. 3). This second input to OR-gate 70 may be referred to as an incoming displacement signal, as indicated at 71, which, as will be described below, indicates that the neighboring nozzle providing the incoming displacement signal has been selected to eject a fluid drop (e.g., has nozzle select signal having a select value) but the nozzle is defective (e.g., has a displacement bit 30 having disable value).

For logic instance 68, AND-gate 72 has a first input coupled to the output of OR-gate 70, a second input receiving the corresponding displacement bit 30 from nozzle displacement mask register 13 via path 34, and an output coupled to the second input of the OR-gate 70 of the logic instance 68 corresponding to a second neighboring nozzle 18 (e.g., the "downstream" nozzle, N+1, of the column of nozzles 18 in the illustrative example of FIG. 3). For each logic instance 68, the output of AND-gate 72 may be referred to as "outgoing displacement signal" 73, which represents the "incoming displacement signal" 71 for OR-gate 70 of logic instance 68 corresponding to the second neighboring nozzle. In one example, when arranged in a column, for a given nozzle 18, the first and second neighboring nozzles may represent the immediately adjacent nozzles on either side of the nozzle (e.g., nozzles N−1 and N+1 respectively represent the first and second neighboring nozzles of nozzle N in the illustrative example of FIG. 3).

For logic instance 18, AND-gate 74 has a first input couple to the output of OR-gate 70, a second input receiving the corresponding displacement bit 30 from nozzle displacement mask register 13 via inverter 75, and an output providing actuation signal 36 to the corresponding nozzle 18.

An example of the operation of fluidic die 10 of FIG. 3, in particular, the operation of the example implementation of actuation logic 13, is described below with regard to the operation of nozzle N. When corresponding nozzle select signal 32 has a select value (e.g., a "1") and corresponding displacement bit 30 has an enable value (e.g., a "0", meaning that nozzle N is operational), OR-gate 70 provides a "HI" input to the first input of AND-gate 74 and displacement bit 30, via inverter 75, provides a "HI" input to the second input of AND-gate 74. As a result, AND-gate 74 provides an actuation signal 36 having an actuation value to AND-gate 62 of nozzle N which, in-turn, in conjunction with fire pulse 54, causes controllable switch 60 to actuate fluid actuator 20 to eject a fluid drop from the corresponding nozzle.

When nozzle select signal 32 has a select value (e.g., a "1") and corresponding displacement bit 30 has a disable value (e.g., a "1", meaning that nozzle N is defective), OR-gate 70 provides a "HI" input to AND-gate 74, but displacement bit 30, via inverter 75, provides a "LO" input to AND-gate 74, such that AND-gate 74 provides actuation signal 36 having a non-actuation value to nozzle N. As such, even though corresponding nozzle select signal 32 has a select value, actuation logic 16 does not cause nozzle N to eject a fluid drop.

Instead, with OR-gate 70 providing a "HI" output to AND-gate 72, and displacement bit 30 also providing a "HI" value to AND-gate 72, AND-gate 72 provides an outgoing displacement signal 73 having an active a value (e.g. a "HI") which serves as incoming displacement signal 71 to the second input of OR-gate 70 of the logic instance 68 of second neighboring nozzle N+1. In response to the incoming displacement signal 71 from logic instance 68 of nozzle N, if the displacement bit 30 corresponding to nozzle N+1 has an enable value (e.g., a "0"), AND-gate 74 of downstream nozzle N+1 will provide an actuation signal 36 having an actuation value causing nozzle N+1 to eject a fluid drop. It is noted that, according to the arrangement of actuation logic 14 of FIG. 3, if the displacement bit 30 of downstream nozzle N+1 also has a disable value (e.g., a "1", meaning that nozzle N+1 is also defective), AND-gate 72 of nozzle N+1 will provide an outgoing displacement signal 73 having an active value (e.g., a logic "HI") to the logic instance 78 of its second neighboring nozzle, nozzle (N+2, not shown), and so on, until the closest downstream nozzle is actuated to eject a fluid drop.

With reference to nozzle N, when corresponding nozzle select signal 32 has a non-select value (e.g., a "0"), if displacement bit 30 has an enable value (e.g., a value of "0") and a displacement signal 71 having an active value is received from AND-gate 72 corresponding to nozzle N−1 (meaning that nozzle N−1 is defective), AND-gate 74 of nozzle N will provide an actuation signal 36 having an actuate value to cause nozzle N to eject a fluid drop. It is noted that if nozzle N is operative, and the nozzle select signal for nozzle N has a select value while simultaneously receiving a displacement signal from nozzle N1, nozzle N will actuate only once to eject a single fluid drop.

As described above, according to the example implementation of FIG. 3, while actuation logic 14 passes or displaces a select signal for a given defective nozzle in a cascading fashion until the nearest "downstream" operational nozzle is found, any number of logic schemes may be employed. For example, actuation logic 14 may be employed such that only the immediately adjacent downstream (or upstream) nozzle serves as a replacement nozzle. In another example, a given nozzle may be cross-connected in a cascading fashion only with the immediately adjacent neighboring nozzles (such as nozzles only nozzles N−1 and N+1 serving as replacement nozzles for nozzle N, for example). Any number of other suitable implementations are possible based on the states of nozzle select signals 32 and displacement bits 30.

Figure 4:
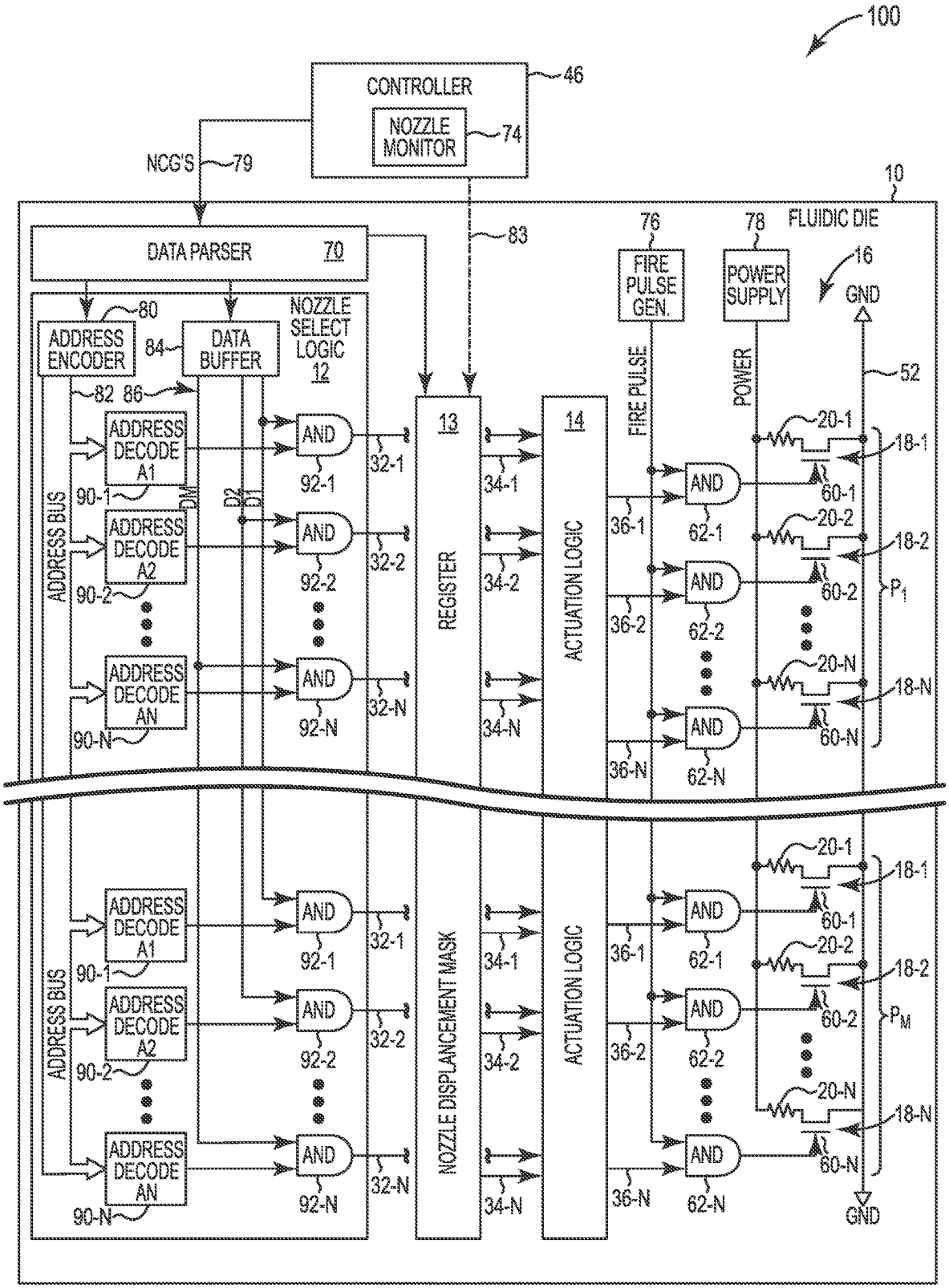
FIG. 4 is a block and schematic diagram illustrating a fluid ejection system including a fluidic die, according to one example

FIG. 4 is a block and schematic diagram generally illustrating portions of a fluid ejection system 100 including a controller 46 and fluidic die 10 employing nozzle displacement mask register 13 and actuation logic 14 for displacing actuation signals from defective nozzles 18 to neighboring nozzles 18 which are operational, according to one example. Fluidic die 10, according to the illustrated example, further includes a fire pulse generator 76 to generate fire pulse 54, and a power supply 78 to supply power to power line 50. It is noted that fluid ejection system 100 of FIG. 4 represents only one example of such a system, and any number of other suitable implementations are possible, including any number of suitable nozzle configurations and nozzle select schemes.

In the example of FIG. 4, array 16 includes a column of nozzles 18 grouped to form a number of primitives, illustrated as primitives P1 to PM, with each primitive including a same number of nozzles, illustrated as nozzles 18-1 to 18-N, with each nozzle including a fluid actuator 20, a controllable switch 60, and a corresponding AND-gate 62. Each primitive, P1 to PM, has a same set of addresses, illustrated as addresses A1 to AN, with each address corresponding to a respective one of the nozzles 18-1 to 18-N.

Fluidic die 10 includes a data parser 70 which, according to the example of FIG. 4, receives data in the form of NCGs (nozzle column groups) from controller 46 via a data path 79, where NCGs, as will be described in greater detail below (see FIGS. 5 and 6) include actuation data and address data for nozzles 18. In one example, controller 46 includes a nozzle monitor 74 which monitors the operability of nozzles 18 of fluidic die 10 using any suitable technique, such as optical drop detect and drive bubble detect, for example. In one case, nozzle monitor 74 maintains a displacement bit 30 for each nozzle 18-1 to 18-N of each primitive P1 to PM, the state of each displacement bit indicative of whether the nozzle 18 is operative or defective (e.g., a "0" indicates a nozzle is operative, and a "1" indicates a nozzle is defective). In one example, nozzle monitor 74 provides nozzle displacement data in the form of displacement bits 30 to fluidic die 10 in the form of a NCG via communications path 79 along with actuation data. In another case, nozzle monitor 74 may provide nozzle displacement bits 30 to nozzle displacement mask register 13 via other communication paths, such as communication path 83 (e.g., a serial I/O path between controller 46 and fluidic die 10).

In one example, nozzle select logic 12 includes an address encoder 80 which encodes addresses of the set of addresses of primitives P1 to PM, as received via data parser 70 from controller 46, onto an address bus 82. A data buffer 84 places actuation data for nozzles 18, as received via data parser 70 from controller 46, onto a set of data lines 86, illustrated as data lines D1 to DM, with one data line corresponding to each primitive P1 to PM. For each nozzle 18-1 to 18-N of each primitive P1 to PM, nozzle select logic 12 includes a corresponding address decoder 90 to decode the corresponding address, illustrated as address decoders 90-1 to 90-N, and a corresponding AND-gate 92, illustrated as AND-gates 92-1 to 92-N, the output of which represents the nozzle select signal 32 for the corresponding nozzle, and being illustrated as nozzle select signals 32-1 to 32-N.

In operation, according to one example, controller 46 provides operational data, including nozzle address data, nozzle actuation data, and nozzle displacement data bits 30, to fluidic die 10 in the form of a series of NCG's to instruct nozzles 18 of fluidic die 10 to eject fluid drops and to displace actuation signals from defective nozzles to neighboring nozzles, in accordance with examples of the present disclosure.

Figure 5:
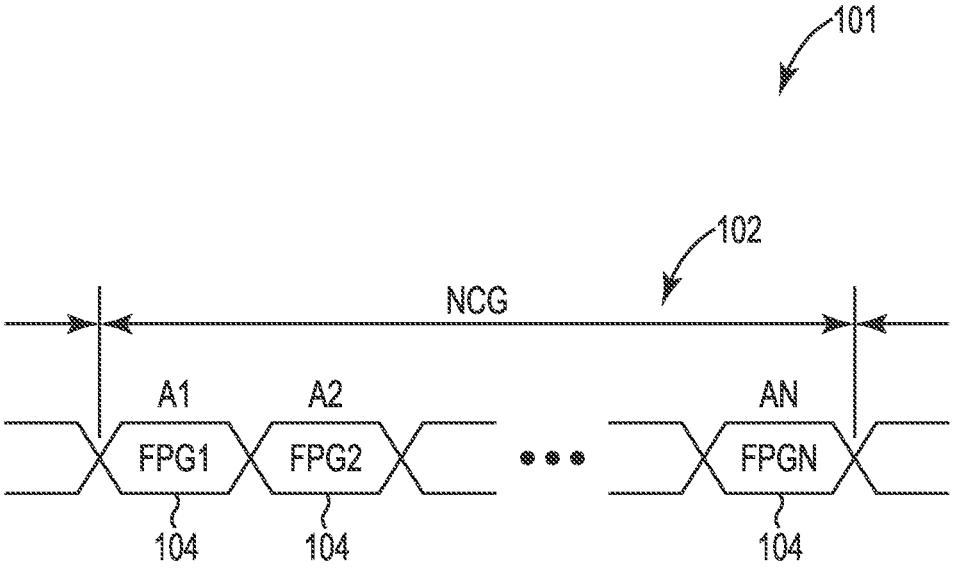
FIG. 5 is a block and schematic diagram generally illustrating an example nozzle column group.

FIG. 5 is a block diagram generally illustrating a portion of a series 101 of NCGs 102 defining an actuation event. Each NCG 102 includes a series of N fire pulse groups (FPGs) 104, with each FPG 104 corresponding to a different one of the addresses of the set of addresses A1 to AN of a primitive. Although illustrated as being arranged sequentially from address A1 to AN, FPGs 104 may be arranged in any number of different orders. In one example, each NCG 102 may include a displacement FPG which includes displacement data bits for each nozzle 18 of the column of nozzles, and which precedes the series of N FPGs.

Figure 6:
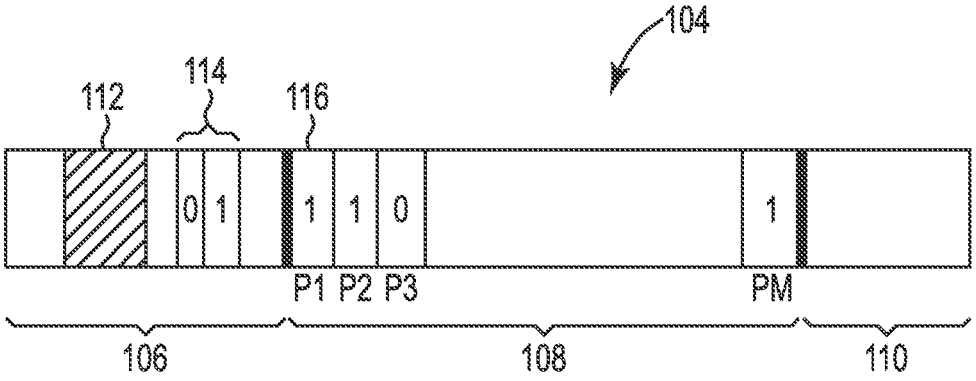
FIG. 6 is a block and schematic diagram generally illustrating an example fire pulse group.

FIG. 6 a block diagram generally illustrating a FPG 104, according to one example. FPG 104 includes a header portion 106, an actuation data portion 108, and a footer portion 110. According to one example, header portion 106 includes address bits 112 indicative of the address of the set of addresses A1 to AN to which the FPG corresponds. In one example, actuation data portion 108 includes a series of actuation bits 116, with each actuation bit 116 corresponding to a different one of the primitives P1 to PM, such that each actuation bit 116 corresponds to a nozzle 18 at the address represented by address bits 112 in a different one of the primitives P1 to PM. In one example, header portion 106 may include one or more displacement identifier bits 114 which indicate whether the FPG is a displacement FPG where for such a displacement packet, as described above, the actuation data portion 108 includes displacement data bits 30 for each nozzle 18 of the column (e.g., for each nozzle 18-1 to 18-N of each primitive P1 to PM) in lieu of actuation bits.

Returning to FIG. 4, in operation, data parser 70 receives the series of NCGs 101 from controller 46. For each FPG 104 of each NCG 102, data parser 70 provides the address data 112 to address encoder 80, which encodes the corresponding address onto address bus 82, and provides the actuation bits to data buffer 84, which places each of the actuation bits 116 onto its corresponding data line D1 to DM, as indicated at 86. In one example, when data parser 70 identifies an FPG 104 as a displacement FPG based on displacement identifier bits 114 in header portion 106, data parser 70 provides the displacement bits 30 to nozzle displacement mask register 30, one displacement bit 30 for each nozzle 18, and each displacement bit having an enable value (e.g., a "0") or a disable value (e.g. a "1"). In one example, displacement bits 30 are provided to nozzle displacement mask register 13 via communications path 83.

The encoded address on address bus 82 is provided to each address decoder 90-1 to 90-N of each primitive P1 to PM, with each of the address decoders 90 corresponding to the address encoded on bus 82 providing an active or "HI" output to the corresponding AND-gate 92. If the actuation data on the corresponding data line D1 to DM has an actuation value, the AND-gate 92 outputs a nozzle select signal 32 having a select value (e.g., a value of "1") to actuation logic 14. For example, if the encoded address from a received FPG 104 corresponds to address A2, address decoders 90-2 of each primitive P1 to PM provides a "HI" output to each corresponding AND-gate 92-2. If the actuation data on the corresponding data line D1 to DM has an actuation value, the AND-gate 92-2 outputs nozzle select signal 32-2 having a select value to actuation logic 14.

Continuing with the illustrative example, actuation logic 14, in turn, such as described by FIG. 3, provides an actuation signal 36-2 having an actuation value to the corresponding nozzle 18-2 or to a neighboring nozzle 18 (e.g., nozzles 18-3, 18-4, not shown) based on the state of the corresponding displacement bit 30 in nozzle displacement mask register 13. For instance, if the displacement bit 30 corresponding to nozzle 18-2 has an enable value (meaning that nozzle 18-2 is operational), actuation logic 14 provides an actuation signal 32-2 having an actuation value to cause nozzle 18-2 to eject a fluid drop. If the displacement bit 30 corresponding to nozzle 18-2 has a disable value (meaning that nozzle 18 is defective), actuation logic 14 does not provide an actuation signal to nozzle 18-2, but instead provides an actuation signal 32 having an actuation value to a neighboring nozzle 18, such as nozzle 18-1 or nozzle 18-3 (not shown), for example.

As noted above, although illustrated in FIG. 4 as being disposed in a column and arranged in primitive groups, in other examples, nozzles 18 may be disposed in any number of suitable arrangements other than in columns or in primitives of fixed size. Similarly, any number of suitable addressing and data schemes other than that illustrated by FIG. 4 may be employed by fluid ejection system 100 and nozzle select logic 12 for selecting and providing actuation data to nozzles 18 of fluidic die 10. For instance, address data, actuation data, and nozzle displacement data may be provided in forms other than FPGs 104.

Figure 7:
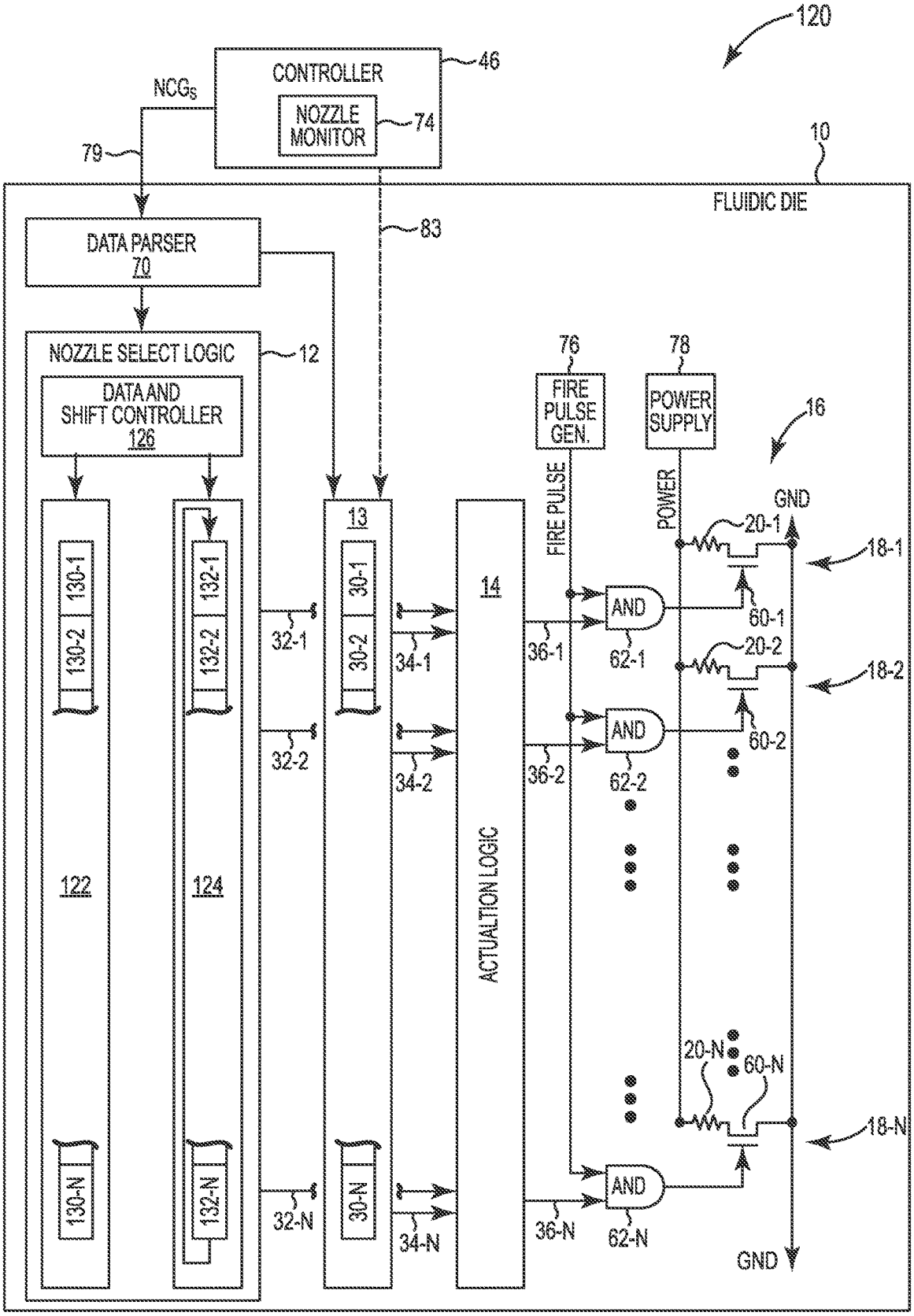
FIG. 7 is a block and schematic diagram illustrating a fluid ejection system including a fluidic die, according to one example.

For instance, FIG. 7 is a block and schematic diagram generally illustrating portions of a fluid ejection system 120 including a controller 46 and fluidic die 10 according to one example. In contrast to illustrated example of FIG. 4, the nozzles 18 of array 16 of fluidic die 10 are not arranged in a number of fixed primitives, but are instead configured in a continuous column of N nozzles, as illustrated by nozzles 18-1 to 18-N. While nozzle displacement mask register 13 and actuation logic 14 are similar to the illustrative implementation of FIG. 4, since nozzles 18 are not arranged in fixed primitives having with nozzles having fixed addresses, nozzle select logic 12 of fluidic die 120 of FIG. 7 does not employ an address bus and address encoders/decoders or data lines, but instead employs an actuation data register 122, an actuation shift mask register 124, and a data and shift controller 126.

In operation, according to one example, actuation data register 122 receives actuation data bits 130 for the full column of nozzles 18-1 to 18-N from controller 46 via data parser 70 and data/shift controller 126, with each data bit 130-1 to 130-N respectively corresponding to nozzles 18-1 to 18-N, and each actuation bit having an actuate value (e.g., a "1") or a non-actuate value (e.g., a "0"). In one example, actuation shift mask register 124 is loaded with an actuation mask pattern, the actuation mask pattern including N mask bits, each mask bit at a bit position 132-1 to 132-N and having an enable value (e.g., a "1") or a disable value (e.g., a "0"). According to one example, when an actuation bit 130 has an actuate value ("1") and it's corresponding mask bit 132 has an enable value ("1"), nozzle select logic 12 provides to actuation logic 14 a nozzle select signal 32 having a select value ("1) for the corresponding nozzle 18. For instance, if actuation bit 130-1 has an actuate value and mask bit 132-1 has an enable value, nozzle select logic 13 provides to actuation logic 14 a nozzle select signal 32-1 having a select value for corresponding nozzle 18-1. Actuation logic 14 then provides an actuation signal 36 to nozzle 18-1 or to a neighboring nozzle 18 (e.g., nozzle 18-2) depending on a state of the corresponding nozzle displacement bit 30-1 in nozzle displacement mask register 13.

In one example, the mask pattern loaded into actuation shift mask register 124 is such that a certain subset of nozzles 18-1 to 18-N is initially enabled to be actuated to eject fluid drops depending on the values of actuation data bits 130. In one example, data and shift controller 126 then shifts the mask pattern within actuation shift mask register 124 so that a different subset of nozzles 18-1 to 18-N is enabled. The shifting of the mask pattern by data and shift controller 126 is repeated until each nozzle 18-1 to 18-N has been enabled for a given set of actuation data in actuation data register 122. In one example, this process is repeated for each set of actuation data loaded into actuation data register 122.

A different mask pattern may be loaded into and shifted through actuation shift mask register 124 for each set of actuation data (column data) loaded into actuation data register 124, such that the mask pattern effectively enable nozzles 18-1 to 18-N to be arranged into virtual primitives which may vary in size (i.e., a number of nozzles) for different actuation events. In one example, the mask pattern for actuation shift mask register 124 may be received from controller 46. In one example, data and shift controller 126 may provide predetermined mask patterns to actuation shift mask register 124 based on shift mask bits included in a header portion of data packets received from controller 46.

Again, any suitable nozzle select logic for providing nozzle select signals 32 to actuation logic 14, and for displacing actuation signals from defective nozzles to operational nozzles, may be employed. The examples of FIGS. 3, 4, and 7 are only illustrative examples of such suitable schemes.

Figure 8:
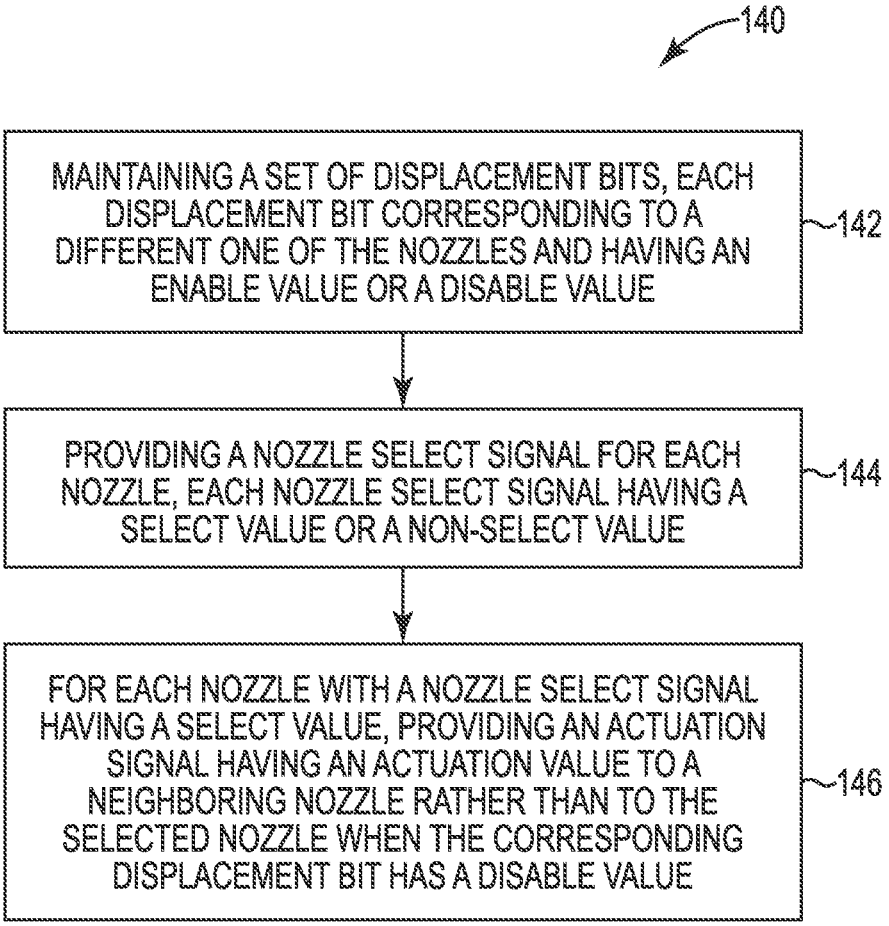
FIG. 8 is a flow diagram generally illustrating a method of operating a fluidic die, according to one example.

FIG. 8 is a flow diagram generally illustrating a method 140 of operating a fluidic die including an array of nozzles, such fluidic die 10 including an array 16 of nozzles 18 as illustrated by FIGS. 1-4 and 7, where each nozzle ejects a fluid drop in response to a corresponding actuation signal having an actuation value, such as nozzles 18 ejecting fluid drops in response to corresponding actuation signals 36 having actuation values, as illustrated by FIG. 1.

At 142, method 140 includes maintaining a set of displacement bits, each displacement bit corresponding to a different one of the nozzles and having an enable value or a disable value, such as nozzle mask displacement mask register 13 of FIG. 1 including displacement bits 30, where an enable value indicates that the corresponding nozzle is operational and a disable value indicates that the corresponding nozzle is defective. In one example, a controller, such as controller 46 of FIGS. 4 and 7, monitors the operability of nozzles 18 of array 16 using any suitable technique, such as optical drop detect and drive bubble detect techniques, for example.

At 144, method 140 includes providing, for each nozzle, a nozzle select signal having a select value or a non-select value, such as nozzle select logic 12 providing a nozzle select signal 32 for each nozzle 18, as illustrated by FIGS. 1-4 and 7. In one example, nozzle select logic 12 provides nozzle select signals having select or non-select values based on actuation data and address data corresponding to each nozzle.

At 146, for each nozzle having a corresponding nozzle select signal having a select value, method 140 includes providing an actuation signal having an actuation value to a neighboring nozzle instead of the selected nozzle when the corresponding displacement bit has a disable value, such as actuation logic 14 of FIG. 3 providing an actuation signal having an actuation value to nozzle N+1 in lieu of nozzle N when the nozzle select signal 32 for nozzle N has a select value but the displacement bit 30 has a disable value.

By displacing an actuation event away from a defective nozzle to a neighboring nozzle based on the value of the corresponding displacement bit in the on-die nozzle displacement register, the process of redirecting actuation data away from defective nozzles is offloaded from the data pipeline between the off-die controller and the fluidic die.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A fluidic die comprising:

an array of nozzles, each nozzle to eject a fluid drop in response to a corresponding actuation signal having an actuation value;

nozzle select logic to provide for each nozzle a nozzle select signal having a select value or a non-select value, a select value indicating the nozzle is selected to eject a fluid drop;

a nozzle displacement register receiving displacement bits, each displacement bit corresponding to a different one of the nozzles and having an enable value or a disable value, an enable value indicating an operational nozzle and a disable value indicating a defective nozzle; and actuation logic, for each nozzle having a corresponding nozzle select signal having a select value and a corresponding displacement bit having a disable value, the actuation logic including a plurality of logic elements which are interconnected to:

provide an actuation signal having an actuation value to an operational neighboring nozzle instead of to the selected nozzle.

2. The fluidic die of claim 1, for each nozzle having a corresponding nozzle select signal having the select value, the actuation logic to provide an actuation signal having an actuation value to a nearest operational neighboring nozzle when the corresponding displacement bit has a disable value instead of to the selected nozzle.

3. The fluidic die of claim 1, the array of nozzles arranged to form a number of primitives, for each nozzle having a corresponding nozzle select signal having the select value, the actuation logic to provide an actuation signal having an actuation value to a neighboring nozzle within the primitive of the selected nozzle when the corresponding displacement bit has a disable value.

4. The fluidic die of claim 1, for each nozzle having a corresponding nozzle select signal having a select value, the actuation logic to provide an actuation signal having an actuation value to the nozzle when the corresponding displacement bit has an enable value.

5. The fluidic die of claim 1, the activation logic including a logic instance for each nozzle, each logic instance receiving the corresponding nozzle select signal, the corresponding displacement bit, and an incoming displacement signal having an active value or an inactive value from the logic instance of a first neighboring nozzle with an active value indicating that the first neighboring nozzle is selected to eject a fluid drop but is defective, each logic instance to provide:

an actuation signal having an actuation value to the corresponding nozzle when the nozzle select signal has the select value and the corresponding displacement bit has the enable value;

an actuation signal having an actuation value to the corresponding nozzle when the corresponding displacement bit has the enable value and the incoming displacement signal has the active value;

an outgoing displacement signal having an active value to the logic instance of a second neighboring nozzle when the nozzle select signal has the select value and the corresponding displacement bit has the disable value; and an outgoing displacement signal having an active value to the logic instance of the second neighboring nozzle when the incoming displacement signal has the active value and the corresponding displacement bit has the disable value.

6. The fluidic die of claim 5, the array of nozzles being arranged in a column, with the first neighboring nozzle and second neighboring nozzle are either side of a nozzle in the column.

7. The fluidic die of claim 1, the nozzle select logic to:

receive actuation data bits, each actuation data bit corresponding to a different one of the nozzles and having an actuation value or a non-actuation value; and provide a select signal having a select value for a nozzle when the corresponding actuation data bit has an actuation value and address data corresponding to the nozzle has an enable value.

8. The fluidic die of claim 7, the nozzle select logic to:

receive actuation data bits, each actuation data bit corresponding to a different one of the nozzles and having an actuation value or a non-actuation value; and provide a select signal having a select value for a nozzle when the corresponding actuation data bit has an actuation value and a mask bit of an actuation mask pattern corresponding to the nozzle has an enable value.

9. A fluid ejection system comprising:

a controller providing actuation data including actuation data bits, each data bit having an actuation value or a non-actuation value; and a fluidic die including:

an array of nozzles, each nozzle to eject a fluid drop in response to a corresponding actuation signal having an actuation value;

a nozzle displacement register including a set of displacement bits, each displacement bit corresponding to a different one of the nozzles and having an enable value or a disable value, a disable value indicating a defective nozzle;

nozzle select logic having address data corresponding to each nozzle having an enable value or a non-enable value, the nozzle select logic to:

receive the actuation data bits, each actuation data bit corresponding to a different nozzle; and provide for each nozzle a nozzle select signal having a select value when the corresponding actuation data bit has the actuation value and the corresponding address data has the enable value; and actuation logic, for each nozzle having a corresponding nozzle select signal having a select value, the actuation logic to:

provide an actuation signal having an actuation value to a neighboring nozzle instead of to the selected nozzle when the corresponding displacement bit has a disable value.

10. The fluid ejection system of claim 9, the address data comprising a fixed address corresponding to each nozzle.

11. The fluid ejection system of claim 9, the address data comprising a mask bit of an actuation mask pattern corresponding to the nozzle.

12. The fluid ejection system of claim 9, the controller to:

monitor the operability of each nozzle of the array using a nozzle monitoring scheme comprising an optical drop detect scheme and a drive bubble detect scheme; and to provide the set of displacement bits based on the nozzle monitoring scheme.

13. A method of operating a fluidic die including an array of nozzles, each nozzle to eject a fluid drop in response to a corresponding actuation signal having an actuation value, the method comprising:

providing for each nozzle a nozzle select signal having a select value or a non-select value;

maintaining a set of displacement bits in a register disposed on the fluidic die, each displacement bit corresponding to a different one of the nozzles and having an enable value or a disable value, a disable value indicating that the corresponding nozzle is defective; and for each nozzle having a corresponding nozzle select signal having a select value, providing, via on-die actuation logic including a plurality of interconnected logic elements, an actuation signal having an actuation value to a neighboring nozzle instead of the selected nozzle when the corresponding displacement bit has a disable value.

14. The method of claim 13, the providing of a nozzle select signal for each nozzle including:

receiving actuation data bits, each actuation data bit corresponding to a different nozzle and having an actuation value or a non-actuation value, each nozzle further having corresponding address data having an enable value of non-able value; and providing for each nozzle the nozzle select signal having a select value when the corresponding actuation data bit has the actuation value and the corresponding address data has the enable value.

15. The method of claim 13, maintaining a set of displacement bits including monitoring an operability of each nozzle using a nozzle monitoring technique including at least one of an optical drop detect scheme and a drive bubble detect scheme.

* * * * *